US011746723B2

(12) United States Patent
Tsukahara et al.

(10) Patent No.: US 11,746,723 B2
(45) Date of Patent: Sep. 5, 2023

(54) CYLINDER BLOCK FOR ENGINE

(71) Applicant: TOYOTA JIDOSHA KABUSHIKI KAISHA, Aichi (JP)

(72) Inventors: Takeshi Tsukahara, Nagoya (JP); Yosuke Yamaguchi, Toyota (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 18/058,774

(22) Filed: Nov. 25, 2022

(65) Prior Publication Data

US 2023/0167782 A1 Jun. 1, 2023

(30) Foreign Application Priority Data

Nov. 29, 2021 (JP) ..... 2021-193410

(51) Int. Cl.
*F02F 1/18* (2006.01)
*F02F 7/00* (2006.01)

(52) U.S. Cl.
CPC ..... *F02F 1/18* (2013.01); *F02F 7/0021* (2013.01); *F02F 7/0082* (2013.01)

(58) Field of Classification Search
None
See application file for complete search history.

(56) References Cited

FOREIGN PATENT DOCUMENTS

JP 20033906 A 1/2003

OTHER PUBLICATIONS

Drag Cartel, "Billet Honda K24-SERIES Engine Block", Aug. 28, 2022, https://web.archive.org/web/20220828145038/https://dragcartel.com/products/billet-honda-k24-series-engine-block (Year: 2022).*
Wikipedia, "Honda K Engine," https://web.archive.org/web/20230307215813/https://en.wikipedia.org/wiki/Honda_K_engine#K24, Apr. 2, 2022 (Year: 2022).*

* cited by examiner

*Primary Examiner* — Kevin A Lathers
(74) *Attorney, Agent, or Firm* — HAUPTMAN HAM, LLP

(57) ABSTRACT

A cylinder block that can be used commonly in a longitudinally mounted engine and a transversely mounted engine without increasing a manufacturing cost. The cylinder block comprises an attachment flange joined to a transmission or a transaxle, and an oil pan or the oil pan and a ladder frame are attached to a lower end thereof. The attachment flange comprises: a first flange formed on an outer periphery thereof; a first joint surface formed on the first flange to be joined to a matching surface of the transmission; a second flange extending in the inner side of the first flange; and a second joint surface formed on the second flange to be joined to a matching surface of the transaxle.

6 Claims, 9 Drawing Sheets

CYLINDER BLOCK FOR ENGINE

The present disclosure claims the benefit of Japanese Patent Application No. 2021-193410 filed on Nov. 29, 2021 with the Japanese Patent Office, the disclosure of which is incorporated herein by reference in its entirety.

BACKGROUND

Field of the Disclosure

The present disclosure relates to a cylinder block of an engine mounted on vehicles to serve as a prime mover.

Discussion of the Related Art

JP-A-2003-3906 describes an internal combustion engine for automobiles in which a cylinder block may be used commonly in an engine for an FR-type automobile where it is longitudinally mounted in a vehicle, and in an engine for an FF-type automobile where it is transversely mounted. In the cylinder block described in JP-A-2003-3906, a flange part is integrally formed on a rear end of the cylinder block, so that a transmission or a transaxle is coupled to a flange part of an oil pan. In the FR-type automobile, the cylinder block is longitudinally mounted in the vehicle with the transmission. Whereas, in the FF-type automobile, the cylinder block is transversely mounted in the vehicle with the transaxle. A recessed part is cut out and formed at one side part of a lower edge of the flange part, and in the structure for the FR-type automobile, a starter motor is disposed at this position. In the structure for the FF-type automobile, a drive shaft passes through the recessed part, and the starter motor is disposed on the opposite side of the drive shaft, or at an upper part.

As described, in the cylinder block described in JP-A-2003-3906, the flange formed on the cylinder block has an outer shape which may be fit not only in the engine for the FR-type automobile but also in the engine for the FF-type automobile. Specifically, the recessed part as a cut out is formed in the flange so that the cylinder block may be fit not only into the FR-type automobile with the transmission but also into the FF-type automobile with the transaxle, without interference with other members. That is, the cylinder block described in JP-A-2003-3906 may be employed commonly in engines of same model to be mounted in the FR-type automobiles and to be mounted in the FF-type automobiles. However, in order to commonly use the engine block in the engine for the FR-type automobile and in the engine for the FF-type automobile, it is necessary to alter designs and arrangements of a transmission case, a transaxle case, a starter motor, a driveshaft and so on. Therefore, even though a manufacturing cost of the automobile can be reduced to a certain extent, it is still insufficient.

SUMMARY

Aspects of preferred embodiments of the present disclosure have been conceived noting the foregoing technical problems, and it is therefore an object of the present disclosure to provide a cylinder block that can be used commonly in an engine longitudinally mounted on a front-engine rear-wheel drive layout vehicle and an engine transversely mounted on a front-engine front-wheel drive layout vehicle without increasing a manufacturing cost.

An exemplary embodiment of the present disclosure relates to a cylinder block for a vehicular engine comprising an attachment flange. The attachment flange is joined to: a transmission that is arranged such that an input shaft thereof is aligned with a crankshaft of the engine to extend in the longitudinal direction of the vehicle; or a transaxle that is arranged such that an input shaft thereof is aligned with the crankshaft of the engine to extend in the transverse direction of the vehicle. An oil pan or the oil pan and a ladder frame are attached to a lower end of the cylinder block in the vertical direction. In order to achieve the above-explained objective, according to the exemplary embodiment of the present disclosure, the attachment flange comprises: a first flange that is formed on a part of an outer periphery of the attachment flange including the lower end of the cylinder block; a first joint surface that is formed on the first flange to be joined to a matching surface of the transmission opposed to the engine to be combined therewith; a branching section as a boundary between the attachment flange and the first flange in the outer periphery of the attachment flange; a second flange that branches off from the outer periphery that is closer to the attachment flange than the branching section to extend in the inner side of the first flange; and a second joint surface that is formed on the second flange to be joined to a matching surface of the transaxle opposed to the engine to be combined therewith.

In a non-limiting embodiment, the attachment flange may further comprise: a first rib that is formed integrally with the first joint surface of the first flange; and a second rib that is formed integrally with the second joint surface of the second flange. The first rib may be connected to a rib for longitudinal arrangement formed along a matching surface of the oil pan that is joined to the matching surface of the transmission, or a matching surface of the ladder frame that is joined to the matching surface of the transmission. Whereas, the second rib may be connected to a rib for transverse arrangement formed along the matching surface of the oil pan that is joined to the matching surface of the transaxle, or the matching surface of the ladder frame that is joined to the matching surface of the transaxle.

In a non-limiting embodiment, the attachment flange may comprise a boss in which a bolt hole or a screw hole is formed to fix the attachment flange to the transmission or the transaxle, and the boss may be formed in the outer periphery of the attachment flange at a site closer to the attachment flange than the branching section. Another boss for longitudinal arrangement is formed integrally with the rib for longitudinal arrangement formed along any of the matching surfaces of the oil pan and the ladder frame, and a bolt hole or a screw hole may be formed in the another boss for longitudinal arrangement. Likewise, still another boss for transverse arrangement is formed integrally with the rib for transverse arrangement formed along any of the matching surfaces of the oil pan and the ladder frame, and a bolt hole or a screw hole is formed in the still another boss for transverse arrangement. The boss may be connected not only to the another boss for longitudinal arrangement through the outer periphery, the first rib, and the rib for longitudinal arrangement, but also to the still another boss for transverse arrangement through the outer periphery, the second rib, and the rib for transverse arrangement.

In a non-limiting embodiment, the cylinder block may be joined to the transaxle by cutting off the first flange extending from the branching section toward the lower end while leaving the second flange.

In a non-limiting embodiment, the cylinder block may be joined to the transmission while leaving both of the first flange and the second flange.

In general, the definition of a transaxle is a power transmission unit in which a transmission, a differential gear unit, and a driveshaft are combined integrally. In the conventional art, a longitudinally mounted transaxle is also available, and the longitudinally mounted transaxle is arranged such that an input shaft thereof extends coaxially with a crankshaft of an engine in the longitudinal direction of a vehicle. However, in the following descriptions, the definition of the transaxle is limited to a transversely mounted transaxle that is arranged such that an input shaft thereof extends coaxially with a crankshaft of an engine in the transverse direction of a vehicle. Likewise, in the following descriptions, the definition of a transmission is limited to a longitudinally mounted transmission that is arranged such that an input shaft thereof extends coaxially with a crankshaft of an engine in the longitudinal direction of a vehicle.

In an engine to which the cylinder block according to the exemplary embodiment of the present disclosure is applied, an oil pan or a ladder frame and an oil pan is/are attached to a lower end of the cylinder block. According to the exemplary embodiment of the present disclosure, a raw material of the cylinder block may be employed commonly in a longitudinally mounted engine that is combined with the transmission in a front-engine rear-wheel drive (hereinafter abbreviated as FR) layout vehicle, and a transversely mounted engine that is combined with the transaxle in a front-engine front-wheel drive (hereinafter abbreviated as FF) layout vehicle or an FF layout based four-wheel drive layout vehicle. For this purpose, the cylinder block according to the exemplary embodiment of the present disclosure is provided with the attachment flange that is joined to the transmission or the transaxle, and the attachment flange comprises the first flange and the second flange having different configurations. Specifically, the first flange is formed on a part of the outer periphery of the attachment flange including the lower end, and a first joint surface is formed on the first flange to be joined to the matching surface of the transmission employed in the FR layout vehicles. That is, the cylinder block is fixed to the transmission through the first flange by a bolt. Whereas, the second flange that branches off from the outer periphery to extend in the inner side of the first flange, and the second joint surface is formed on the second flange to be joined to the matching surface of the transaxle employed in the FF layout vehicles. That is, the cylinder block is fixed to the transaxle through the second flange by a bolt. In this case, the first flange extending from the branching section toward the lower end is cut off from the raw material of the cylinder block. Consequently, the cylinder block is adapted to be applied to the transversely mounted engine that is combined with the transaxle employed in the FF layout vehicles.

Thus, the cylinder block for the longitudinally mounted engine is transformed into the cylinder block for the transversely mounted engine by cutting off the first flange. Specifically, the raw material of the cylinder block is cast from aluminum alloy or cast iron, and not only the cylinder block applied to the longitudinally mounted engine but also the cylinder block applied to the transversely mounted engine may be formed by machining the common raw material of the cylinder block. According to the exemplary embodiment of the present disclosure, therefore, it is not necessary to alter designs of other parts to allow the engine to be arranged not only longitudinally in the FR layout vehicles but also transversely in the FF layout vehicles. That is, the engine having the cylinder block according to the exemplary embodiment of the present disclosure is allowed to be mounted commonly in the FR layout vehicles and the FF layout vehicles without requiring additional costs to alter designs of other parts. In addition, the raw material of the cylinder block that is applicable not only to the longitudinally mounted engine but also to the transversely mounted engine may be cast using a common casting mold and casting facility. For these reasons, a manufacturing cost of the engine EG may be reduced significantly.

In addition, in the cylinder block according to the exemplary embodiment of the present disclosure, the first rib is formed integrally with the first joint surface of the first flange, and the second rib is formed integrally with the second joint surface of the second flange. Specifically, the first rib extends continuously to the matching surface of the oil pan attached to the lower end of the cylinder block, or the rib for longitudinal arrangement formed on the matching surface of the ladder frame. Likewise, the second rib extends continuously to the matching surface of the oil pan or, the rib for transverse arrangement formed on the matching surface of the ladder frame. That is, in the cylinder block according to the exemplary embodiment of the present disclosure, a rib including the first rib and the rib for longitudinal arrangement, and a rib including the second rib and the rib for transverse arrangement are formed in the attachment flange. Those two ribs serve as reinforcements in the engine combined with the transmission in the FR layout vehicles or the transaxle in the FF layout vehicles. According to the exemplary embodiment of the present disclosure, therefore, rigidity and strength of the engine having the cylinder block may be secured.

Further, in the cylinder block according to the exemplary embodiment of the present disclosure, the boss having the bolt hole or screw hole is formed on the attachment flange. The boss is connected not only to said another boss for longitudinal arrangement through the outer periphery, the first rib, and the rib for longitudinal arrangement, but also to said still another boss for transverse arrangement through the outer periphery, the second rib, and the rib for transverse arrangement. In other words, the boss is connected to said another boss for longitudinal arrangement through the first rib and the rib for longitudinal arrangement, and the boss is also connected to said still another boss for transverse arrangement through the second rib and the rib for transverse arrangement. According to the exemplary embodiment of the present disclosure, therefore, the engine having the cylinder block may be fixed firmly to the transmission or the transaxle by a bolt.

Thus, according to the exemplary embodiment of the present disclosure, the cylinder block may be employed commonly in the engine EG to be mounted longitudinally in the FR layout vehicles and the engine EG to be mounted transversely in the FF layout vehicle. According to the exemplary embodiment of the present disclosure, therefore, a cost of adapting the engine to be mounted commonly in the FR layout vehicles and the FF layout vehicles may be reduced significantly. In addition, the rigidity and the strength of the engine EG having the cylinder block may be secured.

BRIEF DESCRIPTION OF THE DRAWINGS

Features, aspects, and advantages of exemplary embodiments of the present disclosure will become better understood with reference to the following description and accompanying drawings, which should not limit the disclosure in any way.

DETAILED DESCRIPTION OF THE PREFERRED EMBODIMENT(S)

Embodiments of the present disclosure will now be explained with reference to the accompanying drawings. Note that the embodiments shown below are merely examples the present disclosure, and do not limit the present disclosure.

Figure 1:
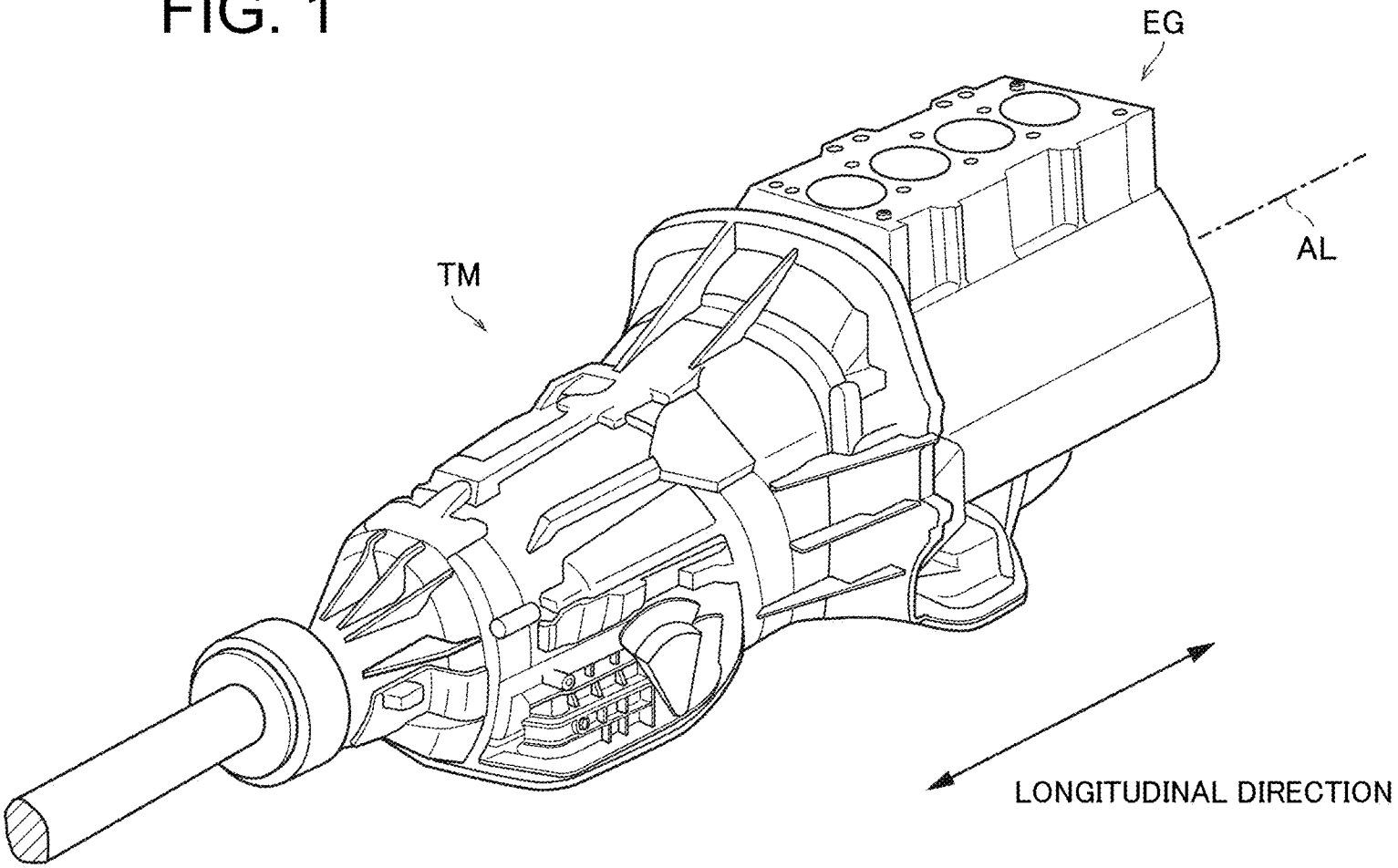
FIG. 1 is a perspective view showing an example of combining a longitudinally mounted engine having the cylinder block according to the exemplary embodiment of the present disclosure with a transmission for the FR layout vehicles.
Figure 2:
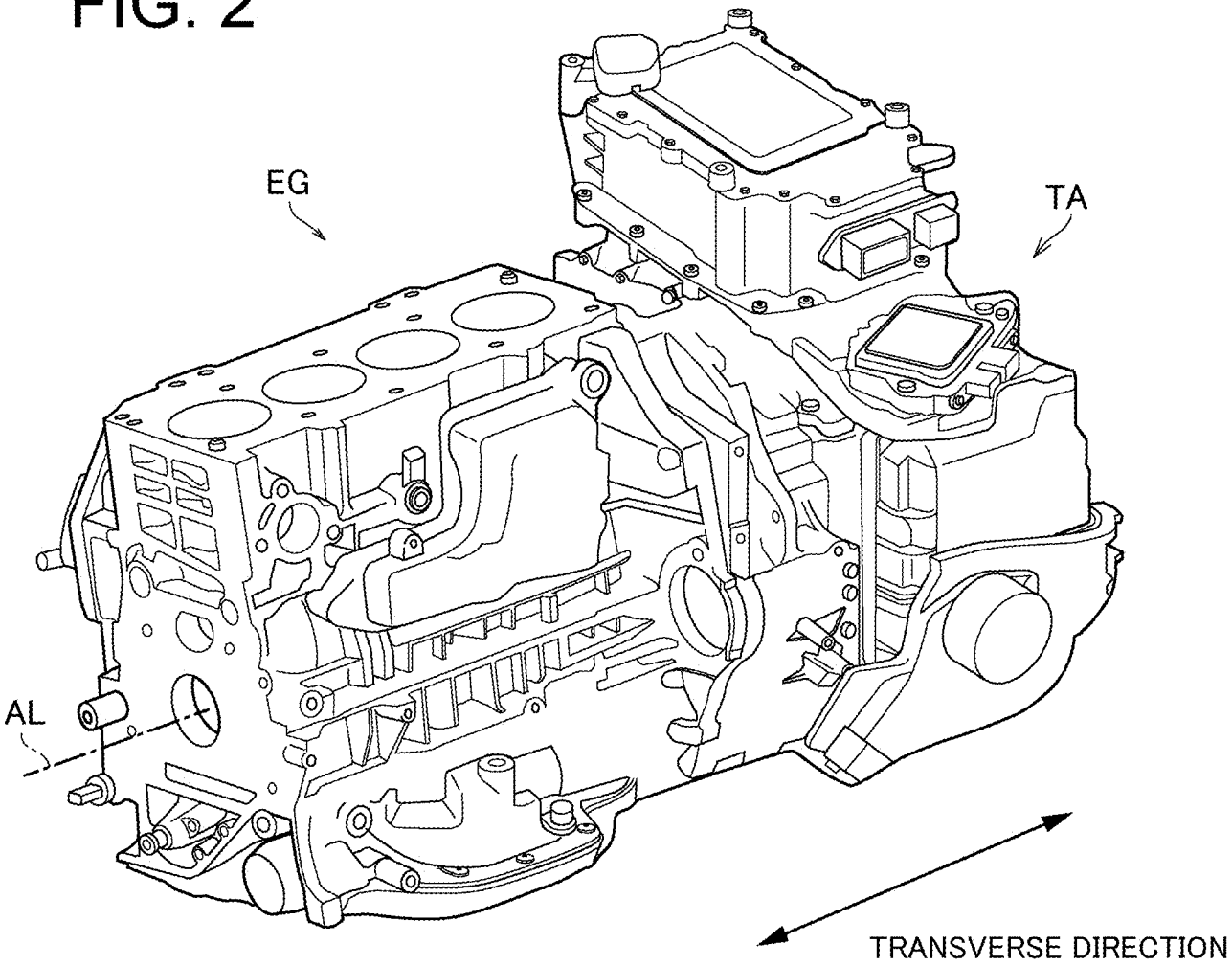
FIG. 2 is a perspective view showing an example of combining a transversely mounted engine having the cylinder block according to the exemplary embodiment of the present disclosure with a transaxle for the FF layout vehicles.

The exemplary embodiment of the present disclosure relates to a cylinder block as a main part of an engine mounted on a vehicle to serve as a prime mover. For example, the cylinder block according to the exemplary embodiment of the present disclosure may be applied to a longitudinally mounted engine EG shown in FIG. 1 arranged in a vehicle such that a rotational axis AL of a crankshaft extends in a longitudinal direction of the vehicle. In the example shown in FIG. 1, the engine EG is combined with a transmission TM for an FR layout vehicle in such a manner that an input shaft (not shown) is aligned with the crankshaft of the engine EG to extend in the longitudinal direction of the vehicle (i.e., in the direction along the rotational axis AL). The cylinder block according to the exemplary embodiment of the present disclosure may also be applied to a transversely mounted engine EG shown in FIG. 2 arranged in a vehicle such that the rotational axis AL of the crankshaft extends in a transversely direction of the vehicle. In the example shown in FIG. 2, the engine EG is combined with a transaxle TA for an FF layout vehicle or an FF layout based four-wheel drive layout vehicle in such a manner that an input shaft (not shown) is aligned with the crankshaft of the engine EG to extend in the transverse direction of the vehicle (i.e., in the direction along the rotational axis AL). Thus, the cylinder block according to the exemplary embodiment of the present disclosure is applied to the engine EG of particular type that is employed commonly in the FR layout vehicles and the FF layout vehicles.

Figure 3:
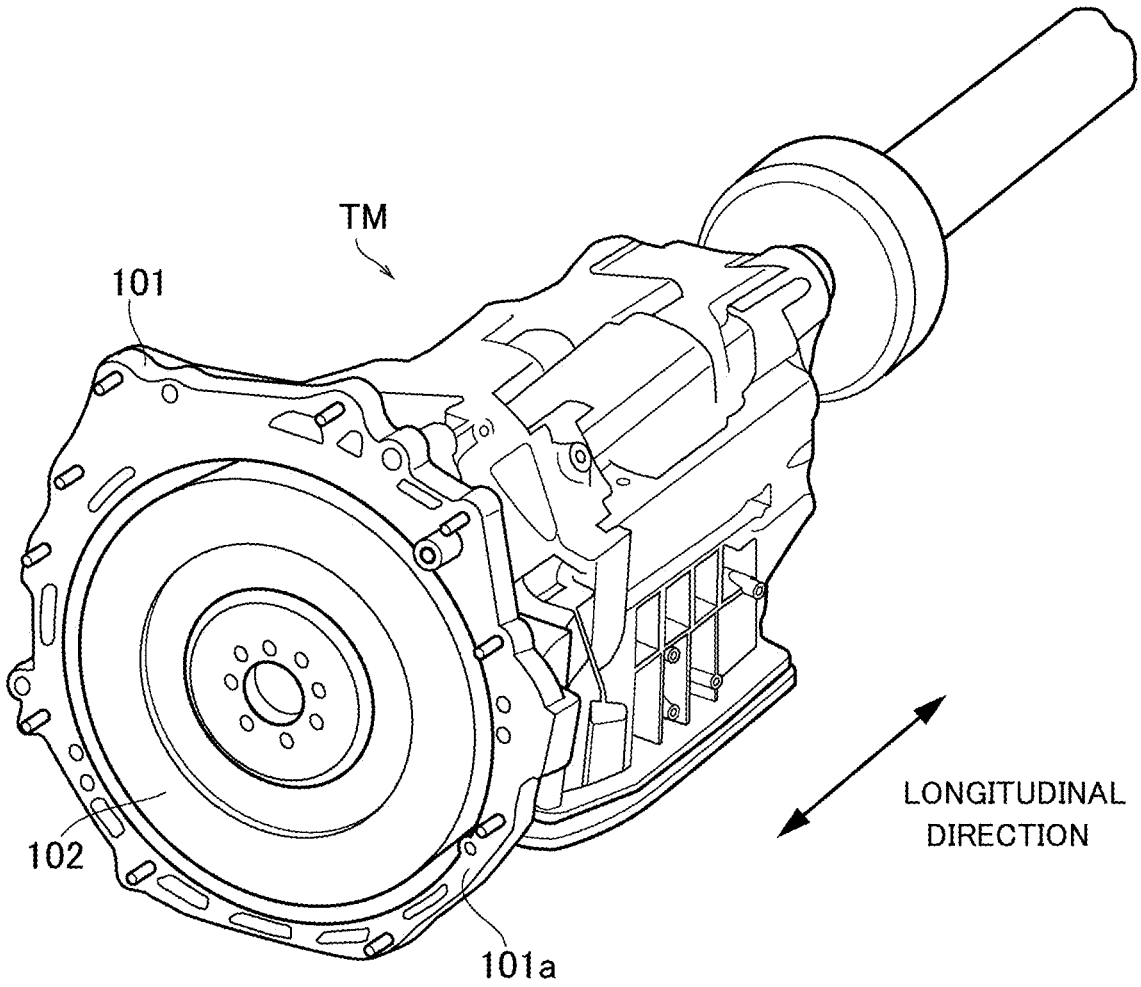
FIG. 3 is a perspective view showing configurations of a flange of the transmission combined with the longitudinally mounted engine having the cylinder block according to the exemplary embodiment of the present disclosure, and a flywheel interposed between the engine and the transmission.
Figure 4:
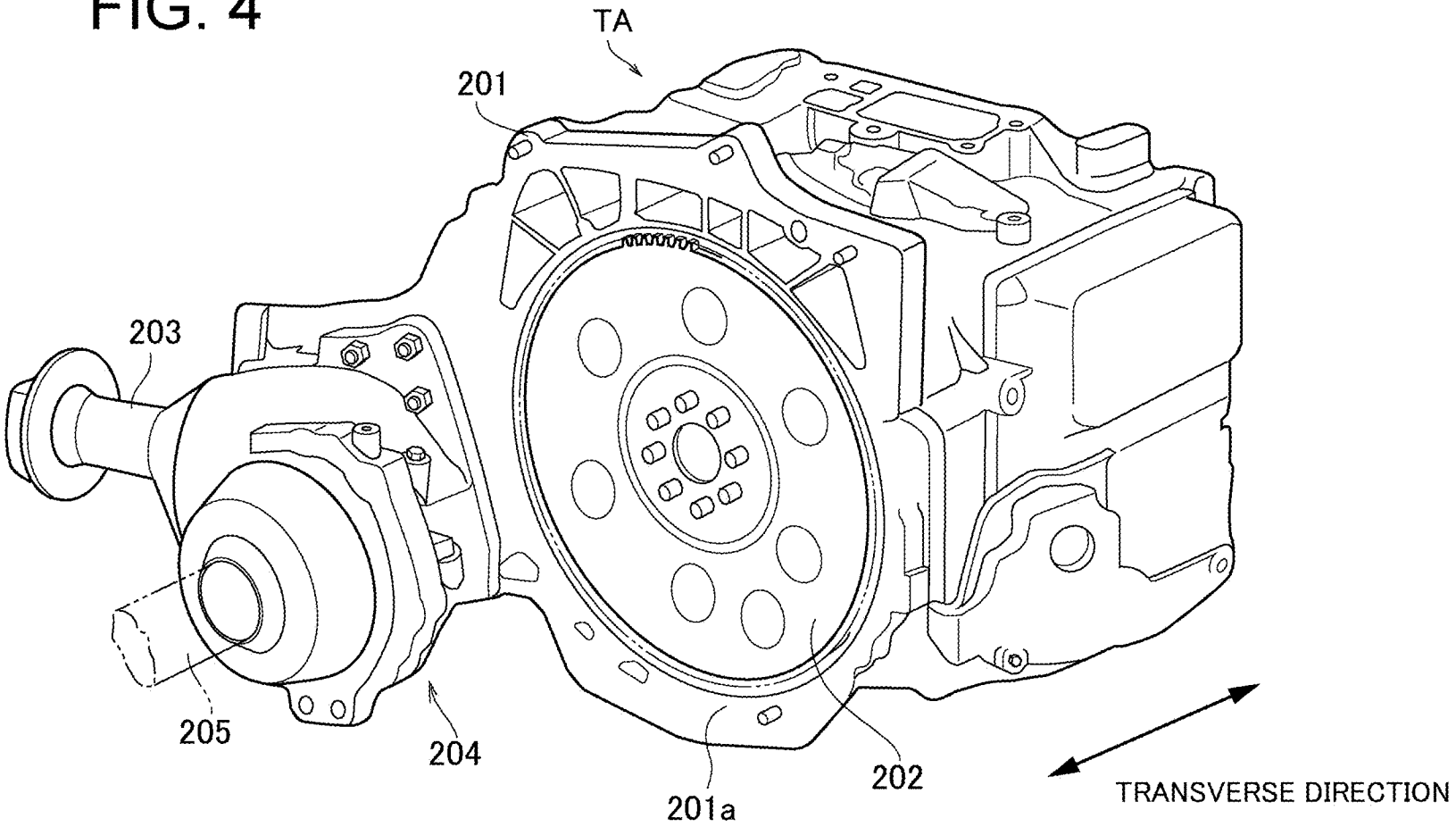
FIG. 4 is a perspective view showing configurations of a flange of the transaxle combined with the transversely mounted engine having the cylinder block according to the exemplary embodiment of the present disclosure, and a flywheel interposed between the engine and the transaxle.

In order to adapt the engine EG to be mounted not only longitudinally on the FR layout vehicle but also transversely on the FF layout vehicle, it is necessary to eliminate interference of the cylinder block with other members of the transmission TM or the transaxle TA. To this end, in the case of combining the engine EG with the transmission TM as illustrated in FIG. 3, it is necessary to provide the cylinder block of the engine EG with an attachment flange that is congruent with an attachment flange 101 of the transmission TM, and whose inner diameter is larger than an outer diameter of a flywheel 102 interposed between the engine EG and the transmission TM. Whereas, in the case of combining the engine EG with the transaxle TA as illustrated in FIG. 4, it is necessary to provide the cylinder block of the engine EG with an attachment flange that is congruent with an attachment flange 201 of the transaxle TA, and whose inner diameter is larger than an outer diameter of a flywheel 202 interposed between the engine EG and the transaxle TA. In this case, the attachment flange has to be shaped into a configuration possible to avoid interference with both of driveshafts 203 extending from the transaxle TA. Given that the transaxle TA comprises a transfer 204 for propelling the FF layout vehicle in a four-wheel drive mode, the attachment flange has to be designed in such a manner as to ensure a space for arranging the transfer 204 and a propeller shaft 205 extending from the transfer 204. In addition, the attachment flange has to be designed taking account of an installation site of a starter motor (not shown) in any of those cases.

Figure 5:
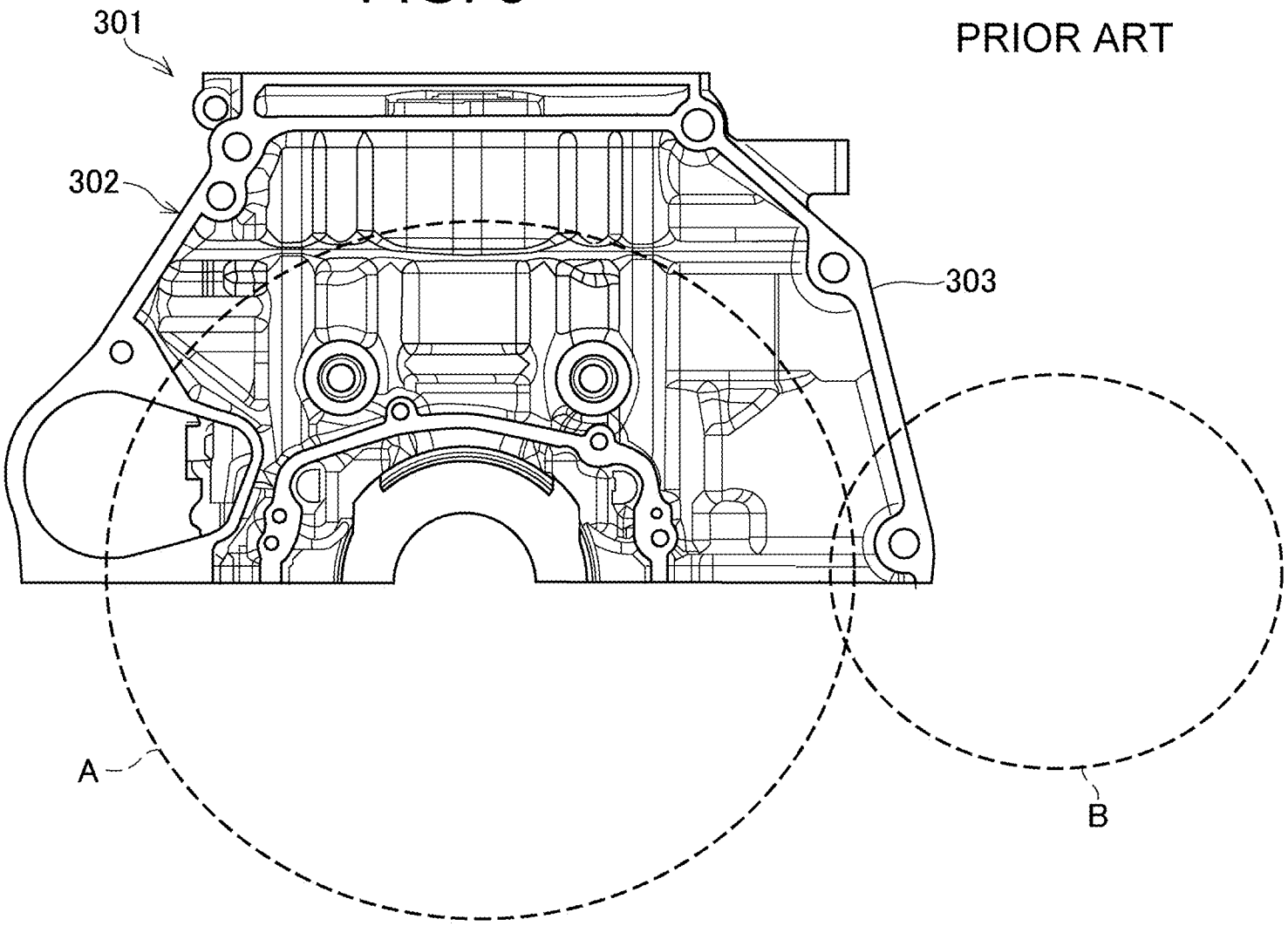
FIG. 5 PRIOR ART
FIG. 5 is a front view of a conventional cylinder block showing an area in which an attachment flange of a conventional cylinder block is positioned in a case that an engine having the attachment flange is joined to a transmission, and an area in which the attachment flange of the conventional cylinder block is positioned in a case that the engine having the attachment flange is joined to a transaxle.

For example, in the case of combining the engine EG with the transmission TM, it is necessary to form the attachment flange on a cylinder block 301 of the engine EG outside of an area A shown in FIG. 5 taking account of the above-explained restrictions. Whereas, in the case of combining the engine EG with the transaxle TA, it is necessary to form the attachment flange outside of an area B shown in FIG. 5. As illustrated in FIG. 5, the attachment flange 302 of the cylinder block 301 according to the prior art is formed such that an outer periphery 303 is positioned outside of the area A. Therefore, the longitudinally mounted engine EG having the cylinder block 301 may be joined to the transmission TM without difficulty. However, the outer periphery 303 of the attachment flange 302 is located inside of the area B. Therefore, the transversely mounted engine EG having the cylinder block 301 may not be joined to the transaxle TA. Thus, the engine EG having the conventional cylinder block 301 may not be joined properly to both of the transmission TM for the FR layout vehicles and the transaxle TA for the FF layout vehicles. In other words, the conventional cylinder block 301 may not be used commonly in the engine EG longitudinally mounted in the FR layout vehicles and in the engine EG transversely mounted in the FF layout vehicles (including the FF layout based four-wheel drive layout vehicles).

As described, according to the exemplary embodiment of the present disclosure, there is provided a cylinder block member that can be used commonly in the particular type of engines EG mounted longitudinally in the FR layout vehicles and transversely in the FF layout vehicles. According to the exemplary embodiment of the present disclosure, therefore, manufacturing costs of the engine EG and the vehicle on which the engine EG is mounted can be reduced significantly.

Figure 6:
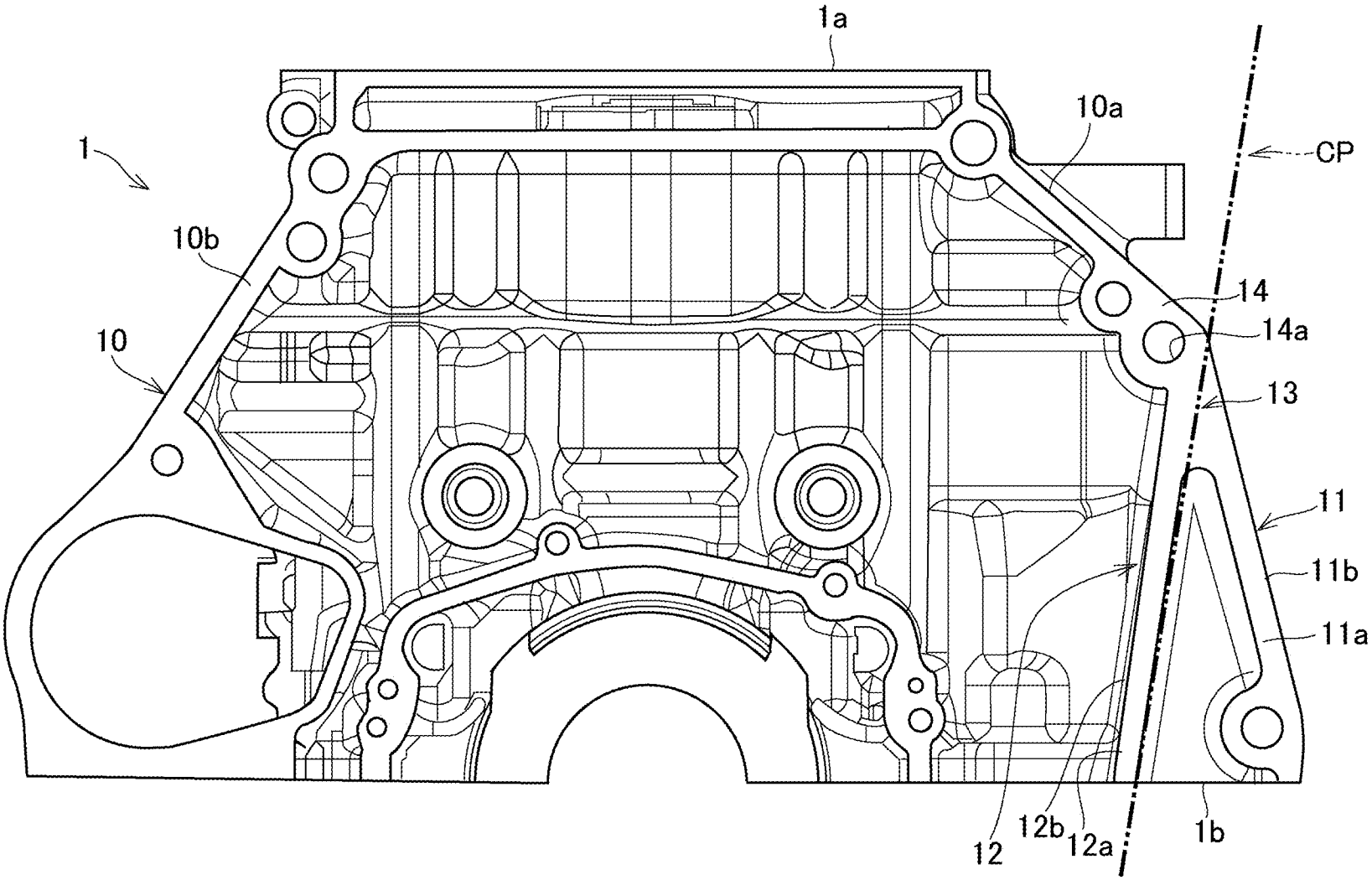
FIG. 6 is a front view of the cylinder block according to the exemplary embodiment of the present disclosure showing configurations of the attachment flange and the joint surface joined to the transmission for the FR layout vehicles or the transaxle for the FF layout vehicles.
Figure 7:
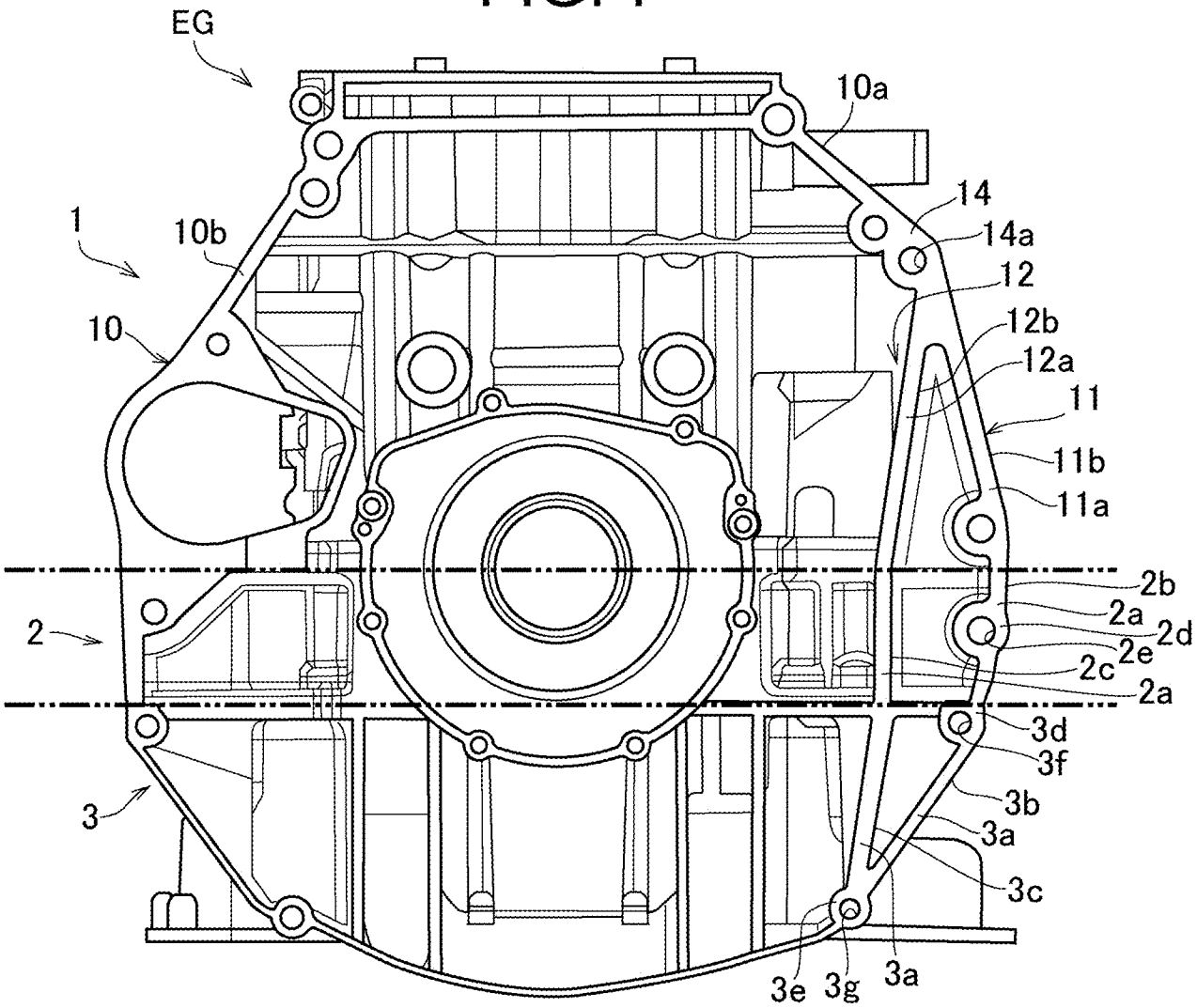
FIG. 7 is a front view of the cylinder block according to the exemplary embodiment of the present disclosure combined with the transmission for the FR layout vehicles, and the ladder frame and the oil pan attached to the cylinder block.

One example of the cylinder block according to the present disclosure is shown in FIGS. 6 and 7. The engine EG to which the cylinder block according to the present disclosure is applied is a reciprocating internal combustion engine that translates reciprocating motions of pistons into a rotary motion of a crankshaft (not shown). In the cylinder block 1, a cylinder head and valves (neither of which are shown) are attached to an upper end 1*a* in the vertical direction, and an oil pan (not shown) is attached to a lower end 1*b*. Otherwise, as illustrated in FIG. 7, a ladder frame 2 and an oil pan 3 are attached to the lower end 1*b* of the cylinder block 1.

The engine EG is designed to be mounted commonly in the FR layout vehicles and the FF layout vehicles. To this end, the cylinder block 1 is provided with an attachment flange 10 that is designed to be joined not only to the transmission TM for the FR layout vehicles but also to the transaxle TA for the FF layout vehicles.

The attachment flange 10 is formed integrally with an end portion of the cylinder block 1 in the vicinity of an output shaft (not shown) of the engine EG. For example, the attachment flange 10 is joined to the flange 101 of the transmission TM shown in FIG. 3 by a bolt. Otherwise, the attachment flange 10 is joined to the flange 201 of the transaxle TA shown in FIG. 4 by a bolt.

The attachment flange 10 comprises a first flange 11, a second flange 12, a branching section 13, and a boss 14. The first flange 11 comprises a first joint surface 11*a* and a first rib 11*b*, and the second flange 12 comprises a second joint surface 12*a* and a second rib 12*b*.

In the example shown in FIGS. 6 and 7, the first flange 11 is formed on a part of an outer periphery 10*a* of the attachment flange 10 from a right part of the outer periphery 10*a* to the lower end 1*b* of the cylinder block 1. In other words, the first flange 11 serve as a part of the outer periphery 10*a* of the attachment flange 10 from the right part of the attachment flange 10 to the lower end 1*b* of the cylinder block 1. Specifically, the first flange 11 is formed on a part of the outer periphery 10*a* of the attachment flange 10 from the branching section 13 to the lower end 1*b* of the cylinder block 1. The first joint surface 11*a* and the first rib 11*b* are formed on the first flange 11.

When joining the engine EG to the transmission TM, the first joint surface 11*a* of the first flange 11 is brought into contact with a matching surface 101*a* of the flange 101 of the transmission TM. As described, the first rib 11*b* is formed integrally with the first joint surface 11*a* of the first flange 11. That is, an end face of the first rib 11*b* opposed to the matching surface 101*a* of the transmission TM serves as the first joint surface 11*a*. As illustrated in FIG. 7, a rib 2*b* for longitudinal arrangement is formed along a matching surface 2*a* of the ladder frame 2 that is joined to the matching surface 101*a* of the transmission TM, and the first rib 11*b* is connected to the rib 2*b* for longitudinal arrangement. In addition, a rib 3*b* for longitudinal arrangement is formed along a matching surface 3*a* of the oil pan 3 that is joined to the matching surface 101*a* of the transmission TM. That is, in the example shown in FIG. 7, the first rib 11*b* is connected to the rib 3*b* of the oil pan 3 through the rib 2*b* of the ladder frame 2 along the first joint surface 11*a*, that is, along a joint surface (or matching surface) 10*b* of the attachment flange 10.

Given that the ladder frame 2 shown in FIG. 7 is not arranged in the engine EG, the oil pan (not shown) is attached to the lower end 1*b* of the cylinder block 1. In this case, the first rib 11*b* is connected to a rib for longitudinal arrangement (not shown) formed on a matching surface of the oil pan that is joined to the matching surface 101*a* of the transmission TM.

The second flange 12 is formed in an inner side of the first flange 11 (i.e., in the left side in FIGS. 6 and 7). Specifically, the second flange 12 branches off from a branching section 13 to extend toward the lower end 1*b* of the cylinder block 1 in the inner side of the first flange 11. More specifically, the second flange 12 branches off from the outer periphery 10*a* of the attachment flange 10 that is closer to the attachment flange 10 than the branching section 13 (where the first flange 11 is not formed) to extend in the inner side of the first flange 11 of the attachment flange 10. The second joint surface 12*a* and the second rib 12*b* are formed on the second flange 12.

When joining the engine EG to the transaxle TA, the second joint surface 12*a* of the second flange 12 is brought into contact with a matching surface 201*a* of the flange 201 of the transaxle TA. As described, the second rib 12*b* is formed integrally with the second joint surface 12*a* of the second flange 12. That is, an end face of the second rib 12*b* opposed to the matching surface 201*a* of the transaxle TA serves as the second joint surface 21*a*. As illustrated in FIG. 7, a rib 2*c* for transverse arrangement is formed along the matching surface 2*a* of the ladder frame 2 that is joined to the matching surface 201*a* of the transaxle TA, and the second rib 12*b* is connected to the rib 2*c* for transverse arrangement. In addition, a rib 3*c* for transverse arrangement is formed along the matching surface 3*a* of the oil pan 3 that is joined to the matching surface 201*a* of the transaxle TA. That is, in the example shown in FIG. 7, the second rib 12*b* is connected to the rib 3*c* of the oil pan 3 through the rib 2*c* of the ladder frame 2 along the second joint surface 12*a*, that is, along the joint surface (or matching surface) 10*b* of the attachment flange 10.

As described, given that the ladder frame 2 shown in FIG. 7 is not arranged in the engine EG, the oil pan (not shown) is attached to the lower end 1*b* of the cylinder block 1. In this case, the second rib 12*b* is connected to a rib for transverse arrangement (not shown) formed on a matching surface of the oil pan that is joined to the matching surface 201*a* of the transaxle TA.

Specifically, the branching section 13 is a point of origin of the first flange 11 in the outer periphery 10*a* of the attachment flange 10. In other words, the branching section 13 is a boundary between the attachment flange 10 and the first flange 11 in the outer periphery 10*a* of the attachment flange 10. As described later, a cut surface CP of the outer periphery 10*a* passes though the branching section 13.

The boss 14 is formed in the outer periphery 10*a* of the attachment flange 10 at a site closer to the attachment flange 10 than the branching section 13, and a bolt hole or screw hole is formed in the boss 14 so as to fix the attachment flange 10 to the transmission TM or the transaxle TA by a bolt. In the example shown in FIG. 7, a bolt hole 14*a* is formed in the boss 14. Specifically, the boss 14 is formed at a site connected not only to a boss for longitudinal arrangement formed on the ladder frame 2 or the oil pan 3 through the outer periphery 10*a*, the first rib 11*b*, and the rib for longitudinal arrangement, but also to a boss for transverse arrangement formed on the ladder frame 2 or the oil pan 3 through the outer periphery 10*a*, the second rib 12*b*, and the rib for transverse arrangement. In the example shown in FIG. 7, the boss 14 is formed in the outer periphery 10*a* at a site where the first flange 11 is not formed, and connected not only to a boss 3*d* for longitudinal arrangement formed on the oil pan 3 through the outer periphery 10*a*, the first rib 11*b*, and the rib 2*b* for longitudinal arrangement, but also to a boss 3*e* for transverse arrangement formed on the oil pan 3 through the outer periphery 10*a*, the second rib 12*b*, and the ribs 2*c* and 3*c* for transverse arrangement.

The boss 3*d* for longitudinal arrangement is formed integrally with the rib 3*b* for longitudinal arrangement on the matching surface 3*a* of the oil pan 3 joined to the matching surface 101*a* of the transmission TM. In the example shown in FIG. 7, a bolt hole 3*f* is formed in the boss 3*d*, and a boss 2*d* for longitudinal arrangement is formed on the ladder frame 2. Specifically, the boss 2*d* for longitudinal arrangement is formed integrally with the rib 2*b* for longitudinal arrangement on the matching surface 2*a* of the ladder frame 2 that is joined to the matching surface 101*a* of the transmission TM. In the example shown in FIG. 7, a bolt hole 2*e* is formed in the boss 2*d*. Although not illustrated in FIG. 7, an additional boss for transverse arrangement may be formed integrally with the rib 2*c* on the matching surface 2*a* of the ladder frame 2.

The boss 3*e* for transverse arrangement is formed integrally with the rib 3*c* of the oil pan 3 on the matching surface 3*a* of the oil pan 3 that is joined to the matching surface 201*a* of the transaxle TA. In the example shown in FIG. 7, a bolt hole 3*g* is formed in the boss 3*e*, and the rib 3*b* for longitudinal arrangement is also formed integrally with the boss 3*e* for transverse arrangement together with the rib 3*c* for transverse arrangement. That is, in the matching surface 3*a* of the oil pan 3, the boss 3*d* for longitudinal arrangement and the boss 3*e* for transverse arrangement are connected to each other through the rib 3*b* for longitudinal arrangement.

Basically, the cylinder block 1 is cast from aluminum alloy or cast iron. Specifically, in order to form the cylinder block 1 shown in FIG. 6, a raw material of the cylinder block 1 is cast, and thereafter the raw material of the cylinder block 1 is finished by machining. The cylinder block 1 shown in FIG. 6 is employed in the engine EG mounted longitudinally in the FR layout vehicles. In this case, the raw material of the cylinder block 1 is casted by the conventional casting method, and thereafter the upper end 1*a*, the lower end 1*b*, the joint surface 10*b* of the attachment flange 10, and the bolt holes 2*e*, 3*f*, and 3*g* etc. are formed by the conventional machining method. Thus, the cylinder block 1 used in the engine EG mounted longitudinally in the FR layout vehicles is manufactured by the conventional methods while leaving both of the first flange 11 and the second flange 12.

Figure 8:
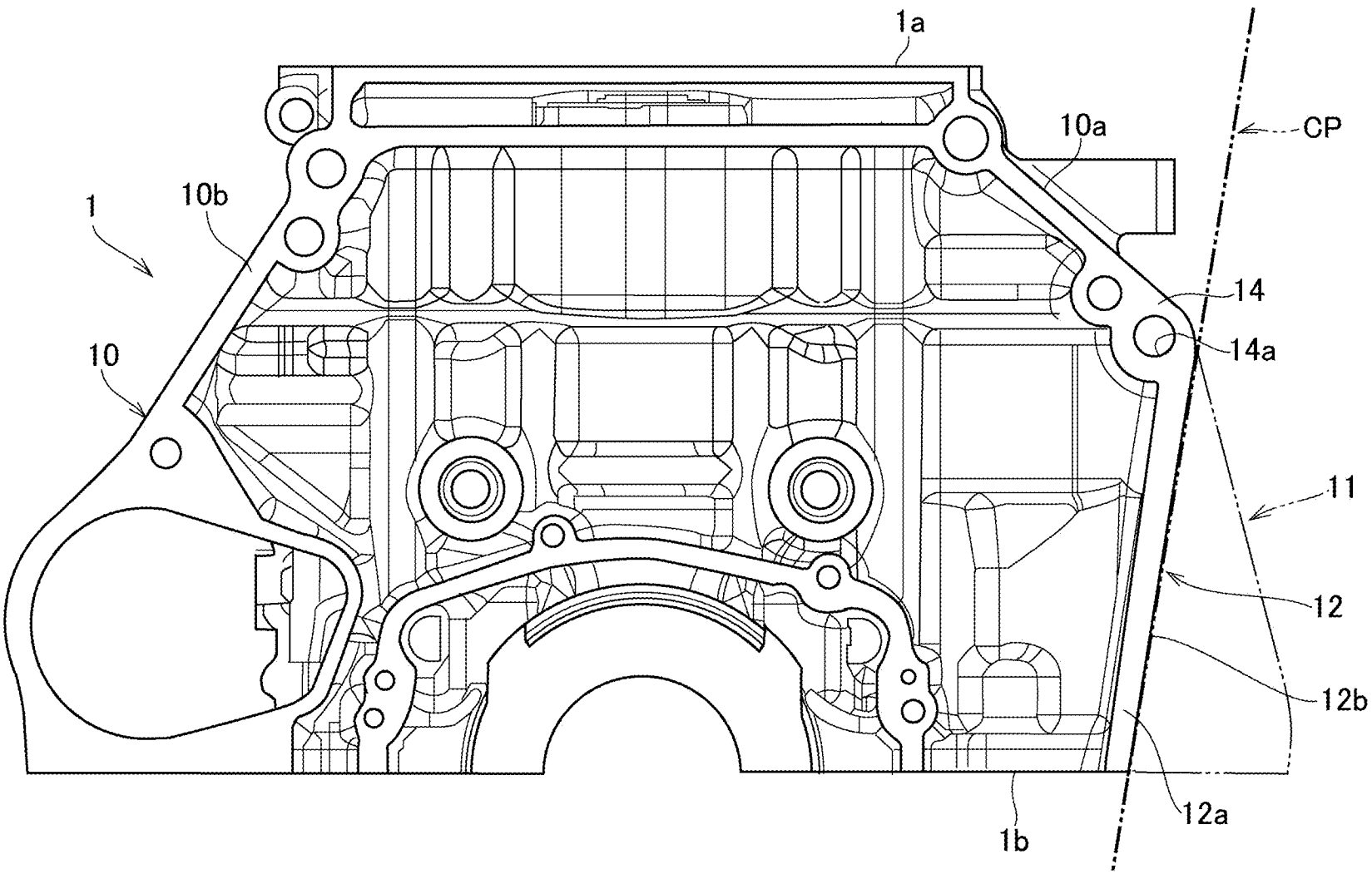
FIG. 8 is a front view of the cylinder block according to the exemplary embodiment of the present disclosure from which the first flange is cut off to be combined with the transaxle for the FF layout vehicles.
Figure 9:
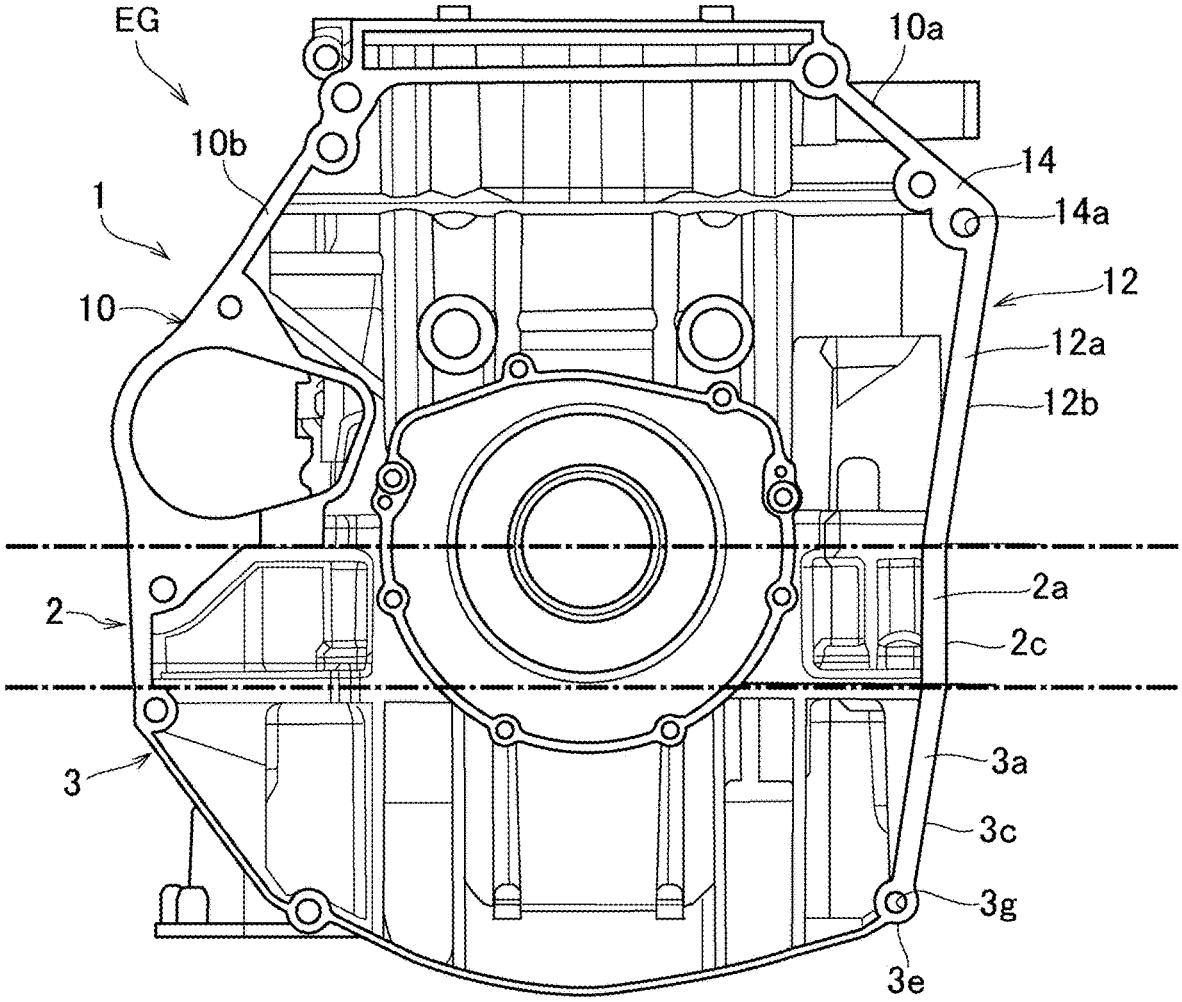
FIG. 9 is a front view of the cylinder block from which the first flange is cut off to be combined with the transaxle for the FF layout vehicles, and the ladder frame and the oil pan attached to the cylinder block.

The cylinder block 1 may also be adapted to be used in the engine EG mounted transversely in the FF layout vehicles by cutting off the first flange 11. Specifically, as illustrated in FIGS. 8 and 9, the cylinder block 1 may be adapted to be used in the transversely mounted engine EG by cutting off the first flange 11 along the cut surface CP. As described, the cut surface CP is a plane including the branching section 13 as a boundary between the attachment flange 10 and the first flange 11 in the outer periphery 10*a*. Thus, the cylinder block 1 shown in FIGS. 8 and 9 for the transversely mounted engine EG may be manufactured from the common raw material that is also used to manufacture the cylinder block 1 shown in FIG. 6 for the longitudinally mounted engine EG. Although the cut surface CP is indicated by the two-dotted dashed line in FIGS. 6 and 8 for the sake of illustration, the cut surface CP is actually a plane expanding from the first joint surface 11*a* of the first flange 11 along the rotational axis AL (i.e., in depth). In FIGS. 8 and 9, common reference numerals are assigned to the elements in common with those of the cylinder block 1 and the engine EG shown in FIGS. 6 and 7.

Thus, in the case of applying the cylinder block 1 to the transversely mounted engine EG, the first flange 11 adapted to be joined to the transmission TM is cut off from the cylinder block 1 as illustrated in FIGS. 8 and 9. Consequently, the cylinder block of the transversely mounted engine EG may be joined to the transaxle TA without hindrance. Thus, the cylinder block 1 shown in FIGS. 6 and 7 may be adapted easily to be employed in the transversely mounted engine EG that is joined to the transaxle TA, by merely cutting off the first flange 11 from the cylinder block 1 while leaving the second flange 12.

FIG. 9 shows the ladder frame 2 without having the rib 2*b* and the boss 2*d* for longitudinal arrangement, and the oil pan 3 without having the rib 3*b* and the boss 3*d* for longitudinal arrangement. The ladder frame 2 shown in FIG. 9 is manufactured by cutting off the rib 2*b* and the boss 2*d* for longitudinal arrangement from the ladder frame 2 shown in FIG. 7 while leaving the rib 2*c* for transverse arrangement. Whereas, the oil pan 3 shown in FIG. 9 is manufactured by cutting off the rib 3*b* and the boss 3*d* for longitudinal arrangement from the oil pan 3 shown in FIG. 7 while leaving the rib 3*c* for transverse arrangement. Thus, the ladder frame 2 and the oil pan 3 shown in FIG. 9 may be manufactured easily by the same principle as applied for manufacturing the cylinder block 1. According to the present disclosure, therefore, the raw materials of the ladder frame 2 and the oil pan 3 may also be used commonly in the longitudinally mounted engine EG shown in FIG. 7 and the transversely mounted engine EG shown in FIG. 9. Otherwise, the ladder frame 2 and the oil pan 3 shown in FIG. 9 may also be dedicated to the transversely mounted engine EG.

Thus, according to the present disclosure, not only the longitudinally mounted engine EG but also the transversely mounted engine EG may be manufactured by machining the common raw material of the cylinder block 1 cast from aluminum alloy or cast iron. In other words, the raw material of the cylinder block 1 may be used commonly to manufacture the longitudinally mounted engine EG and the transversely mounted engine EG. According to the present disclosure, therefore, it is not necessary to alter designs of other parts to allow the engine EG to be arranged not only longitudinally in the FR layout vehicles but also transversely in the FF layout vehicles. That is, the engine EG is allowed to be mounted commonly in the FR layout vehicles and the FF layout vehicles by using the cylinder block 1 without requiring additional costs to alter designs of other parts. In addition, the raw material of the cylinder block 1 that is applicable not only to the longitudinally mounted engine EG but also to the transversely mounted engine EG may be cast using a common casting mold and casting facility. For these reasons, although an additional machining cost to cut off the first flange 11 is required, a manufacturing cost of the engine EG may be reduced significantly in total.

In addition, in the cylinder block 1 according to the present disclosure, the first rib 11*b* of the first flange 11 extends continuously to the rib 2*b* for longitudinal arrangement that is formed along the matching surface (not shown)

of the oil pan or the matching surface 2*a* of the ladder frame 2. Likewise, the second rib 12*b* of the second flange 112 extends continuously to the rib 2*c* for transverse arrangement that is formed along the matching surface (not shown) of the oil pan or the matching surface 2*a* of the ladder frame 2. That is, in the cylinder block 1, a rib including the first rib 11*b* and the rib 2*b* for longitudinal arrangement, and a rib including the second rib 12*b* and the rib 2*c* for transverse arrangement are formed in the attachment flange 10. Those two ribs serve as reinforcements in the engine EG combined with the transmission TM or the transaxle TA. According to the present disclosure, therefore, rigidity and strength of the engine EG having the cylinder block 1 may be secured.

Further, in the cylinder block 1, the boss 14 is connected to the boss 3*d* of the oil pan 3 for longitudinal arrangement through the first rib 11*b* and the rib 2*b* for longitudinal arrangement, and the boss 14 is also connected to the boss 3*e* of the oil pan 3 for transverse arrangement through the second rib 12*b* and the rib 2*c* for transverse arrangement. According to the present disclosure, therefore, the engine EG having the cylinder block 1 may be fixed firmly to the transmission TM or the transaxle TA by the bolt.

Thus, according to the present disclosure, the cylinder block 1 may be employed commonly in the engine EG to be mounted longitudinally in the FR layout vehicles and the engine EG to be mounted transversely in the FF layout vehicles. According to the present disclosure, therefore, a cost of adapting the engine EG to be mounted commonly in the FR layout vehicles and the FF layout vehicles may be reduced significantly. In addition, the rigidity and the strength of the engine EG having the cylinder block 1 may be secured.

What is claimed is:

1. A cylinder block for a vehicular engine, comprising:

an attachment flange that is configured to be joined to:

a transmission that is arranged such that an input shaft of the transmission is aligned with a crankshaft of the engine to extend in a longitudinal direction of a vehicle, or a transaxle that is arranged such that an input shaft of the transaxle is aligned with the crankshaft of the engine to extend in a transverse direction of the vehicle;

wherein an oil pan or the oil pan and a ladder frame are attached to a lower end of the cylinder block in a vertical direction, the attachment flange comprises:

a first flange that is formed on a part of an outer periphery of the attachment flange including the lower end of the cylinder block;

a first joint surface that is formed on the first flange, wherein when the cylinder block is joined to the transmission, the first joint surface is joined to a matching surface of the transmission opposed to the engine to be combined therewith;

a branching section as a boundary between the attachment flange and the first flange in the outer periphery of the attachment flange;

a second flange that branches off from the outer periphery that is closer to the attachment flange than the branching section to extend in an inner side of the first flange;

a second joint surface that is formed on the second flange, wherein when the cylinder block is joined to the transaxle, the second joint surface is joined to a matching surface of the transaxle opposed to the engine to be combined therewith, a first rib that is formed integrally with the first joint surface of the first flange; and a second rib that is formed integrally with the second joint surface of the second flange, the first rib is connected to a rib for longitudinal arrangement formed along a matching surface of the oil pan that is joined to the matching surface of the transmission, or a matching surface of the ladder frame that is joined to the matching surface of the transmission, and the second rib is connected to a rib for transverse arrangement formed along the matching surface of the oil pan that is joined to the matching surface of the transaxle, or the matching surface of the ladder frame that is joined to the matching surface of the transaxle.

2. The cylinder block as claimed in claim 1, wherein the attachment flange comprises a boss in which a bolt hole or a screw hole is formed to fix the attachment flange to the transmission or the transaxle, the boss is formed in the outer periphery of the attachment flange at a site closer to the attachment flange than the branching section, another boss for longitudinal arrangement is formed integrally with the rib for longitudinal arrangement formed along any of the matching surfaces of the oil pan and the ladder frame, a bolt hole or a screw hole is formed in the another boss for longitudinal arrangement, still another boss for transverse arrangement is formed integrally with the rib for transverse arrangement formed along any of the matching surfaces of the oil pan and the ladder frame, a bolt hole or screw hole is formed in the still another boss for transverse arrangement, and the boss is connected to the another boss for longitudinal arrangement through the outer periphery, the first rib, and the rib for longitudinal arrangement, and to the still another boss for transverse arrangement through the outer periphery, the second rib, and the rib for transverse arrangement.

3. The cylinder block as claimed in claim 2, wherein the cylinder block is joined to the transaxle without having the first flange extending from the branching section toward the lower end.

4. The cylinder block as claimed in claim 2, wherein the cylinder block is joined to the transmission.

5. The cylinder block as claimed in claim 1, wherein the cylinder block is joined to the transaxle without having the first flange extending from the branching section toward the lower end.

6. The cylinder block as claimed in claim 1, wherein the cylinder block is joined to the transmission.

* * * * *